US010153561B2

(12) United States Patent
Boyer

(10) Patent No.: US 10,153,561 B2
(45) Date of Patent: Dec. 11, 2018

(54) ANTENNA ARRANGEMENT

(71) Applicant: British Broadcasting Corporation, London (GB)

(72) Inventor: John Boyer, London (GB)

(73) Assignee: British Broadcasting Corporation, London (GB)

( * ) Notice: Subject to any disclaimer, the term of this patent is extended or adjusted under 35 U.S.C. 154(b) by 278 days.

(21) Appl. No.: 14/777,829

(22) PCT Filed: Mar. 20, 2014

(86) PCT No.: PCT/GB2014/050871

§ 371 (c)(1),
(2) Date: Sep. 17, 2015

(87) PCT Pub. No.: WO2014/147401

PCT Pub. Date: Sep. 25, 2014

(65) Prior Publication Data

US 2016/0072196 A1 Mar. 10, 2016

(30) Foreign Application Priority Data

Mar. 20, 2013 (GB) ..... 1305164.4

(51) Int. Cl.
*H01Q 21/26* (2006.01)
*H01Q 1/48* (2006.01)
(Continued)

(52) U.S. Cl.
CPC ..... *H01Q 21/26* (2013.01); *H01Q 1/48* (2013.01); *H01Q 9/16* (2013.01); *H01Q 9/30* (2013.01);
(Continued)

(58) Field of Classification Search
CPC ..... H01Q 21/26
See application file for complete search history.

(56) References Cited

U.S. PATENT DOCUMENTS 3,521,286 A 7/1970 Kuecken
7,064,725 B2 * 6/2006 Shtrikman ..... H01Q 13/10 343/764
(Continued)

FOREIGN PATENT DOCUMENTS

CN 102683853 A 9/2012
EP 0590955 A2 4/1994
(Continued)

OTHER PUBLICATIONS

Kin-Lu Wong, Fu-Ren Hsiao and Chia-Lun Tang, "A low-profile omnidirectional circularly polarized antenna for WLAN access point," IEEE Antennas and Propagation Society Symposium, 2004., 2004, pp. 2580-2583 vol. 3.*
(Continued)

*Primary Examiner* — Jessica Han
*Assistant Examiner* — Amal Patel
(74) *Attorney, Agent, or Firm* — Wood Herron & Evans LLP

(57) ABSTRACT

An antenna arrangement can produce omni-directional polarisations of two or more types and comprises a compact arrangement of a dipole with array comprising first and second conductors in parallel planes separated by a printed circuit board and laid on the printed circuit board for generating horizontally polarised signals. A monopole arrangement comprises a third conductor substantially orthogonal to the planes of the first and second conductors and arranged so that one of the first and second conductors acts as a ground plane for the third conductor.

19 Claims, 7 Drawing Sheets

(51) Int. Cl.

| | |
|---|---|
| ***H01Q 21/29*** | (2006.01) |
| ***H01Q 9/16*** | (2006.01) |
| ***H01Q 9/30*** | (2006.01) |
| ***H01Q 21/20*** | (2006.01) |
| ***H01Q 21/24*** | (2006.01) |

(52) U.S. Cl.
CPC ..... *H01Q 21/205* (2013.01); *H01Q 21/24* (2013.01); *H01Q 21/29* (2013.01)

(56) References Cited

U.S. PATENT DOCUMENTS

| | | | |
|---|---|---|---|
| 2004/0222935 | A1 | 11/2004 | Jan et al. |
| 2010/0123637 | A1 | 5/2010 | Cheng et al. |
| 2010/0315195 | A1 | 12/2010 | Duron et al. |

FOREIGN PATENT DOCUMENTS

| | | | |
|---|---|---|---|
| EP | 0684704 | A2 | 11/1995 |
| EP | 1475860 | A1 | 11/2004 |
| FR | 2644937 | A1 | 9/1990 |
| GB | 1106824 | A | 3/1968 |
| JP | 11261335 | | 9/1999 |
| JP | 2009231927 | A | 10/2009 |
| KR | 1020100097923 | | 9/2010 |

OTHER PUBLICATIONS

S. Suzuki, T. Nakagawa and T. Ikeda, "Development of a High-Quality Low Latency Wireless HDTV Camera Using the Millimeter-Wave Band Using Bidirectional Wireless Transmission for High Operability," The 2011 Annual Technical Conference & Exhibition, Hollywood, CA, USA, 2011, pp. 1-10.*

A low-profile omnidirectional circularly polarized antenna for WLAN access point, Kin-Lu Wong; Dept. of Electrical Engineering, Nat. Sun Yat-Sen University, Kaohslung, Taiwan; Fu-Ren Hsiao; Chia-Lun Tang; 2 pgs.; Jun. 2004.

Intellectual Property Office; Search Report; GB1305164.4; 4 pgs.; dated Jul. 16, 2013.

John Boyer; A compact simple dual polarised antenna for use with the half RF HD radiocamera transmitter; Feb. 25, 2013; 6 pgs.

* cited by examiner

ANTENNA ARRANGEMENT

BACKGROUND OF THE INVENTION

This invention relates to antennas and in particular to antennas for producing more than one polarisation of RF radio waves.

Various forms of RF antenna are known for producing vertical, horizontal, right-hand circular or left-hand circular polarisation of RF radio waves. FIG. 1 shows two arrangements for producing horizontally polarised RF waves. FIG. 1*a* shows a slotted cylinder arrangement in which RF signals are received on a coaxial line coupled to a slot within a cylinder. FIG. 1*b* shows a printed circuit antenna known as an Alford loop having two parallel conductors each arranged in a plane and separated by a dielectric.

FIG. 2 shows various arrangements of antenna for vertical polarisation. FIG. 2*a* is a discone arrangement, FIG. 2*b* is a monopole arrangement and FIG. 2*c* is a sleeved dipole arrangement.

A circularly polarised antenna may be formed from horizontally oriented crossed diploes with a 90° phase shift between them to produce circular polarisation.

SUMMARY OF THE INVENTION

We have appreciated the need for a compact arrangement of antenna capable of producing more than one polarisation of RF waves.

The improvements of the present invention are defined in the independent claims below, to which reference may now be made. Advantageous features are set forth in the dependent claims.

In broad terms, the arrangement embodying the invention comprises an antenna for producing horizontal polarisation and an antenna for producing vertical polarisation combined together such that the antenna for horizontal polarisation acts as a ground plane for the antenna for vertical polarisation.

BRIEF DESCRIPTION OF THE DRAWINGS

An embodiment of the invention will be described in more detail by way of example with reference to the accompanying drawings, in which.

DETAILED DESCRIPTION OF A PREFERRED EMBODIMENT OF THE INVENTION

Antenna arrangements to produce different polarisations of radio waves are used in a variety of different systems. The present embodiment of the invention is applicable to many such systems including radio, television, data transmission and indeed any system in which more than one polarisation may be required. One such system is a radiocamera arrangement in which the camera transmits and receives more than one polarisation.

Radiocameras are particularly useful in their portability. They need to be able to pan through 360° and tilt by maybe ±30° or more and roam in the area to be filmed. One requirement for this operation is that the transmit antenna radiates over the required bearings. Traditional SISO (Single In Single Out) systems have used linearly polarised omni-directional antennas such as discone antennas or collinear arrays and circularly polarised systems use antenna arrays such as Lindenblad arrays (a.k.a. Four Square Dipole array).

An improvement over such radiocameras is the so called "halfRF HD radiocamera" that provides near double spectral efficiency when compared to SISO systems and does this using MIMO (Multiple In Multiple Out) techniques. This requires use of multiple polarisations, which makes the antenna design process more complex. MIMO systems have more than one transmit antenna and more than one receive antenna and code the data into multiple streams. Each stream may be radiated from one or more antennas. Many systems used indoors rely on the scattering from the environment to provide many varied uncorrelated paths between the transmitting and receiving antennas. As radiocameras are used outdoors there is much less scattering of the transmissions, therefore a cross-polarised system is employed to provide differing paths between receive and transmit antennas.

A halfRF HD radiocamera system may use technologies from various DVB standards such as DVB-T, DVB-T2 and the new DVB-NGH standard. DVB-NGH uses many advanced radio frequency techniques including MIMO to provide rugged handheld reception of television. One particular technique used by DVB-NGH combines terrestrial linearly polarised (horizontal and vertical) MIMO transmissions with circularly polarised (left and right hand) MIMO transmissions from satellite to provide transmit diversity. One way of providing this is to use four separate antennas; horizontally polarised, vertically polarised, left hand circularly polarised and right hand circularly polarised antennas and there are a number of well-known options for each of these antennas.

Figure 1:
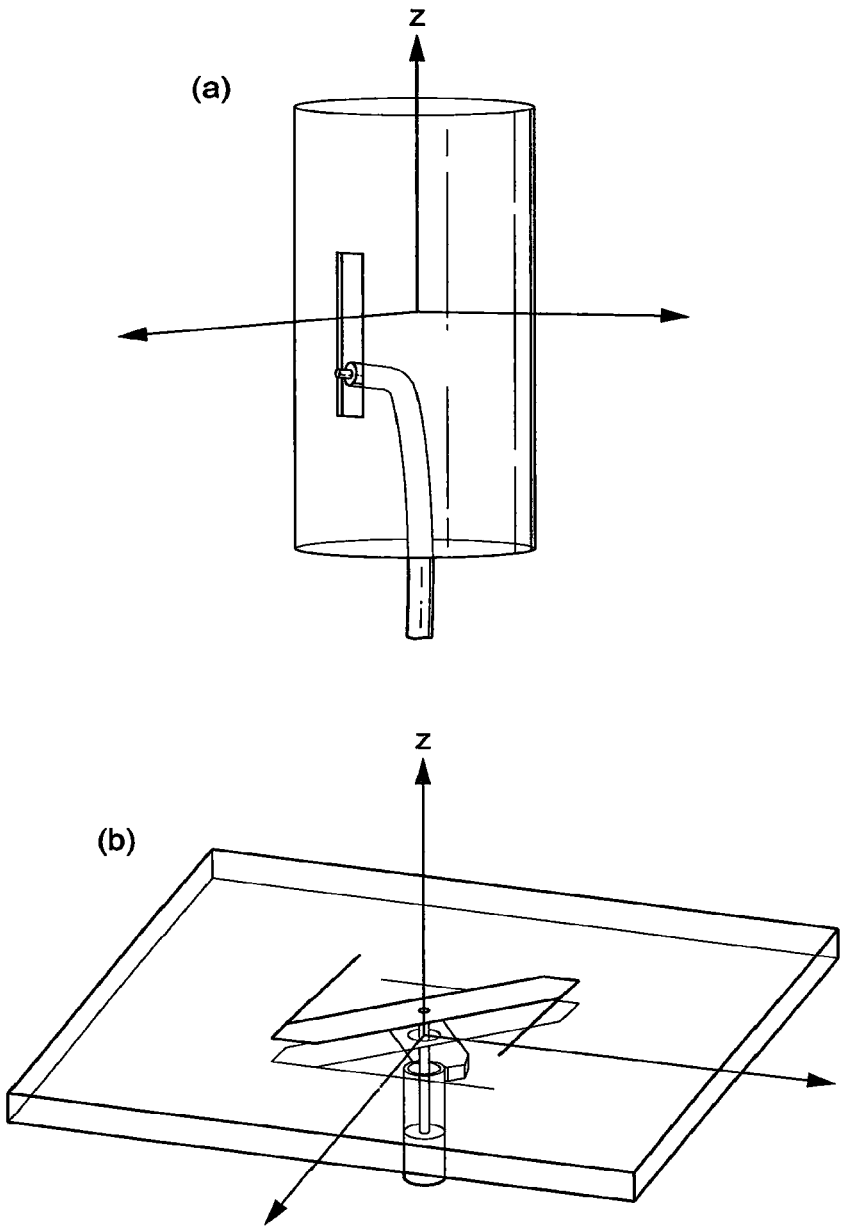
FIG. 1 PRIOR ART
FIG. 1 is a diagram of known arrangements for producing horizontal polarisation.
Figure 2:
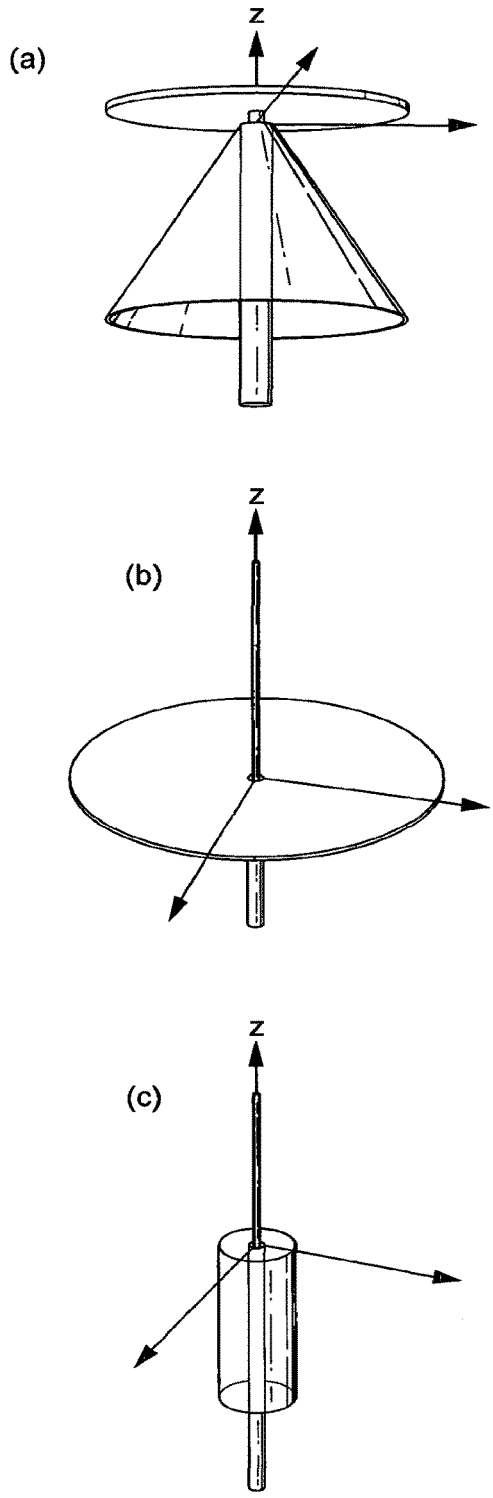
FIG. 2 PRIOR ART
FIG. 2 is a diagram of known arrangements for producing vertical polarisation.

FIG. 1 shows known arrangements for producing various polarisations. Known solutions for an omni-directional horizontally polarised antenna are a printed Alford loop (FIG. 1*b*) or a slotted cylinder (FIG. 1*a*) for producing horizontal polarisation and, for vertical polarisation, possible antennas are a sleeved dipole, a collinear array (FIG. 2*b*), a discone antenna (FIG. 2*a*) or a monopole antenna (FIG. 2*c*).

Circularly polarised antenna may be produced by a Lindenblad array or pair of horizontally oriented crossed dipoles (with a 90° phase shift between them). One circularly polarised antenna would be needed for each of the two circular polarisations. A bifilar helix can be used to produce omnidirectional slant polarisation or circularly polarised radiation, but that requires tricky bending of coaxial cable and one bifilar antenna would be required for each polarisation.

Each of the antennas above is relatively simple and compact, but there would be a requirement for four antennas, which gets to be bulky and expensive.

An alternative method of generating omni-directional patterns would be to use arrays of elements distributed radially (each with approximately 90° horizontal beamwidth) to synthesise a near omni-directional pattern. This technique is commonly used in VHF and UHF broadcasting. An actual array implementation would require power splitters to feed each of the antenna elements, but this array is quite flexible and any polarisation can be radiated depending on the phasing of the inputs to each antenna, also the dipoles could be horizontal and vertical instead of slanted.

Whilst this is an ideal technique at VHF and UHF, building such a dipole array is not easy at other frequencies such as 2 GHz and would be extremely tricky at 7 GHz, but at those frequencies it would be more sensible to build the array using patch elements. This would also require some kind of feed network, which could either be printed on the outside of the boards or could be a printed power splitter sited within the square. Each approach is not without its issues. For instance at higher frequencies the inside dimensions of the box get smaller, so access with tools becomes problematic and with the feed on the outside, a folded pcb also has discontinuities at the corners.

As previously mentioned the halfRF system requires four polarisations. We have appreciated that a more ideal antenna system for many uses would be to have co-sited orthogonally polarised omni-directional antennas, which could be used to generate any required polarisation by changing the phase between them. This can be achieved by adding the appropriate phase shifts at baseband, then two antennas would be required instead of four and each antenna pair would be more compact. Two linearly polarised antennas cannot be spaced apart and still generate circular polarisation. Any distance between them would create deep nulls in any pattern generated. The two orthogonal antennas need to be in virtually the same space. If somehow the two antennas could be combined than a very compact simple to construct dual polarised antenna could be formed.

Figure 3:
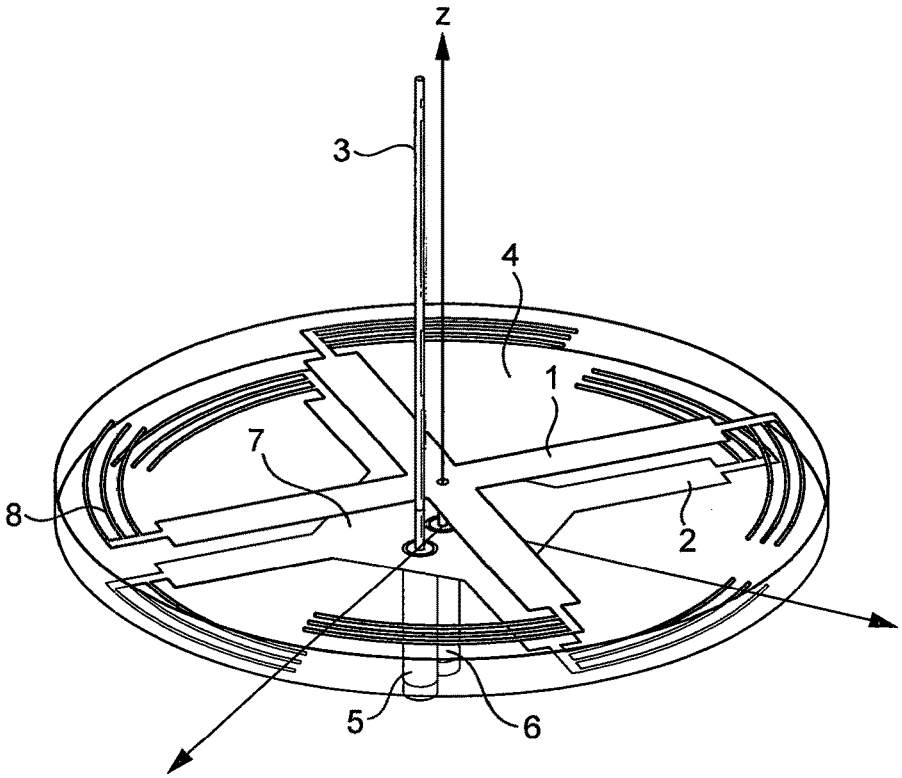
FIG. 3 is a diagram of an arrangement embodying the invention.

We have appreciated that such a dual polarised antenna can be designed as shown in the embodiment of the invention in FIG. 3. The embodiment uses the concept that a printed dipole array and feed looks broadly similar to the ground plane of the monopole antenna so uses a modified dipole array for enhanced bandwidth and with a modification to the lower traces that allows it to be used as a monopole ground-plane.

The antenna arrangement comprises a first conductor 1 arranged on an upper surface of a dielectric. Here, the dielectric is a printed circuit board 4 and the conductor is a track laid on the printed circuit board. A second conductor 2 is arranged on the lower surface of the printed circuit board 4 and has portions parallel to the first track on the upper surface. The plane in which the first conductor 1 is located is parallel to the plane in which the second conductor 2 is located.

The first conductor 1 is arranged with tracks extending in opposing directions from a central position. The conductor also has tracks orthogonal to these tracks extending in the opposing directions also emanating from a central position so as to form a cross like form. The first conductor also has filament conductors 8 at each end of the cross like form which are provided to allow production tuning of the frequency of the antenna. The second conductor 2 is similar to the first conductor 1 and is located on the lower surface of the dielectric, here a printed circuit board. The second conductor also has portions extending in opposing directions from a central position and additional portions extending in opposing directions at right angles to the first portions so to form a generally cross shape arrangement. In addition, the central region 7 of the second conductor is enlarged so as to provide room for connections from coaxial connectors 5 and 6. The region 7 may therefore be considered as a connection region.

A third conductor 3 extends generally perpendicular the plane of the PCB and therefore to the first and second conductors. This third conductor may be a wire or similar filament component such as an extension of the conductor within a coaxial cable. The third conductor extends from the central position 7 of the first and second conductors.

The antenna can be fed with two independent feeds to produce simultaneous horizontal and vertical radiation or it can be fed with complex signals to provide simultaneous left circular (LHCP) and right circular (RCHP) radiation. Construction is very simple in that it requires two equal lengths of coaxial cable to connect to the pcb and a short piece of wire to act as a vertical monopole.

Figure 4:
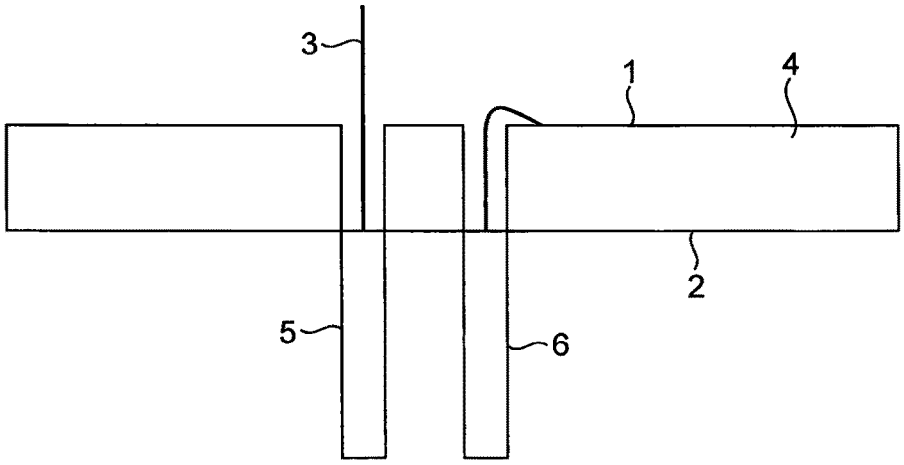
FIG. 4 is a schematic diagram showing the connections to the antenna arrangement of FIG. 3.

The first and second conductors as described with filament conductors 8 form dipole arrays which together produce horizontal omni-directional polarisation of RF waves. The third conductor is a monopole for producing vertical polarisation. The second conductor acts as a ground plane for the third conductor as will now be described showing the connections in FIG. 4. As can be seen in FIG. 4, the coaxial table 5 has an outer connection to the lower of the two conductors 2 on the lower surface and a central conductor that extends through, but without connection to the printed circuit board and forms the third conductor 3. The other coaxial connector 6 has an outer connection to the second conductor 2 on the lower surface and a central portion of the coaxial connector connects to the upper conductor 1 on the upper surface. The coaxial cables thus have a common outer connection to the second conductor 2 on the lower surface. In this way, the second conductor acts as the ground plane for the third conductor.

A compact dual polar omni-directional antenna is therefore provided having two parts which are co-sited. One part produces horizontally polarised radiation and the other vertically polarised radiation. This means that circular polarised waves can be generated by adding a 90° phase shift between the two halves. The design provides that the horizontal antenna forms part of the vertical antenna and allows the minimum distance been the two halves.

We have appreciated that there may be a cost to such an approach in that there is increased coupling between the vertical and horizontal polarisations. However, in the system horizontal and vertical signals may be pre-coded to produce the phase shift required for circular polarisation, this pre-coding may be modified to cancel the coupling between the polarisations.

Other embodiments may be possible with the common feature that the horizontal antenna forms the ground-plane of the vertically polarised antenna allowing co-siting of the antennas. An embodiment allows a compact omni-directional circularly polarised antenna to be formed. Such compactness is particularly beneficial for portable use.

Figure 5:
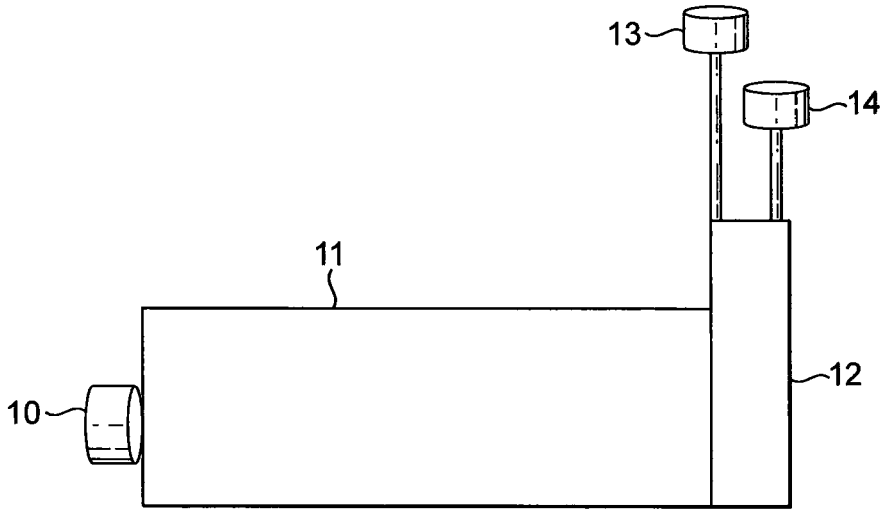
FIG. 5 is a system diagram showing a system incorporating the antenna of FIG. 3.

A camera system embodying the invention is shown in FIG. 5 and comprises a camera having a body 11 housing images sensors, electronics and storage and a lens 10, with a camera back 12 with two antennas mounted on the camera back. The antennas are arranged with an upper antenna 13 and a lower antenna 14, each comprising the arrangement shown and described in relation to FIG. 3 above. One of the two antennas is fed with separate signals so as to broadcast separate horizontal and vertical polarisations. The other antenna is fed with signals having a 90° phase shift, thereby producing left and right circular polarisations. The system thereby produces 4 separate polarisations, horizontal, vertical, left and right circular from 2 small antennas. The camera back 12 may be a removable unit to which the antennas are fitted allowing the different antenna arrangements to easily we swapped into place.

Figure 6:
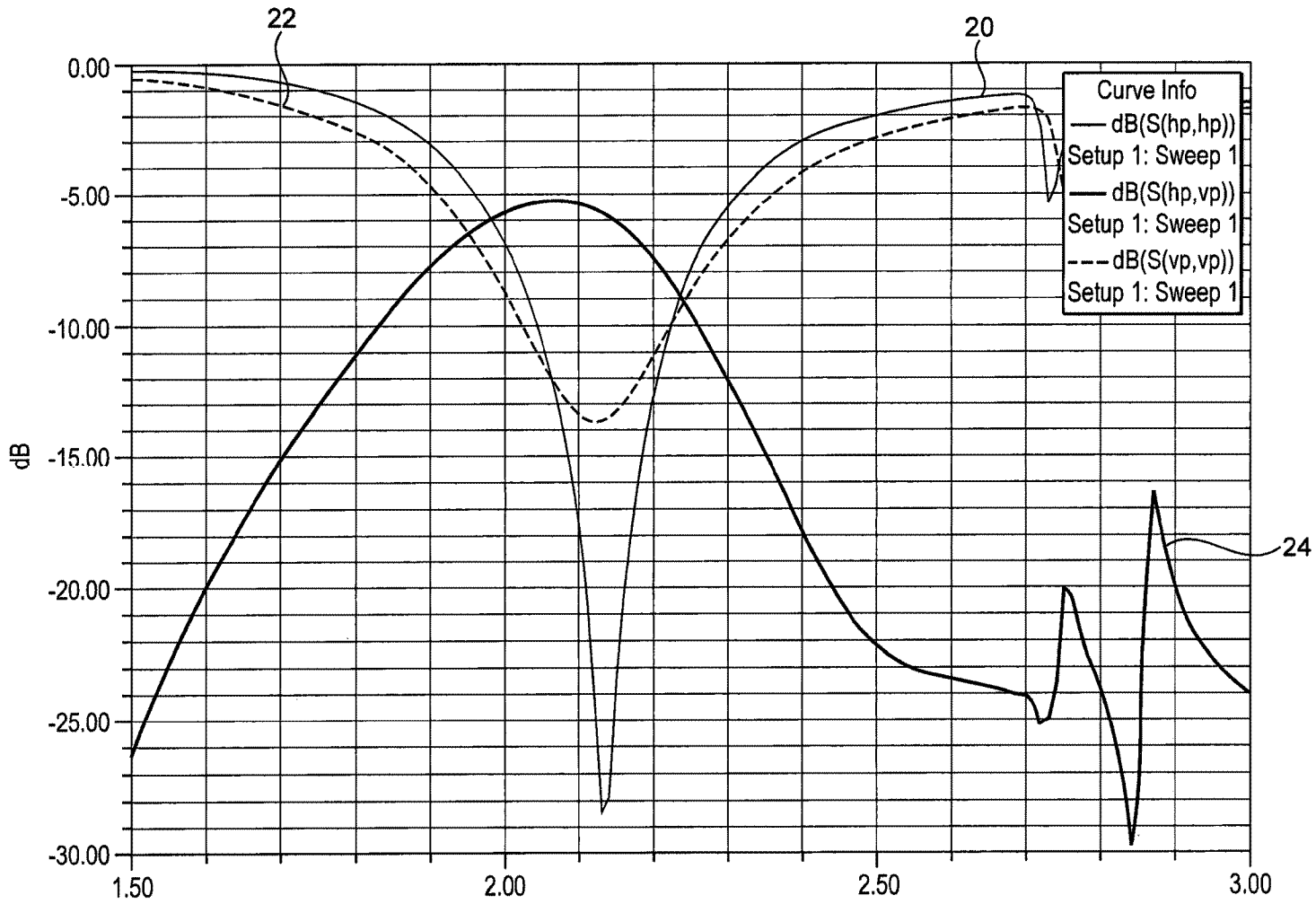
FIG. 6 is a performance plot showing calculated return loss (input match) for each antenna input and the coupling between the two inputs.

The placing of antennas in close proximity has some effect on performance. FIG. 6 is a performance plot showing calculated return loss (input match) for each antenna input and the coupling between the two inputs (only one way is shown as due to reciprocity the coupling is the same both ways). The graphs show the return loss in dB on the y axis from 0 to −30 dB, and frequency in GHz on the x-axis.

The figures show that there is some coupling between the two polarisations, which is expected due to their proximity, but this coupling, is not large and that is reflected in the lack of cross-polar radiation shown in the radiation patterns. If required, the level of cross-polar radiation could be reduced by modifying the MIMO coding as mentioned earlier.

The performance shown in FIG. 6 show that each of the two portions (horizontal is the upper curve 20 and vertical is the lower curve 22) of the antenna have a good input match, better than −10 dB with approximately 10% bandwidth. The coupling (plot 24) between the two antennas is higher than is ideal, due to their proximity.

Figure 7:
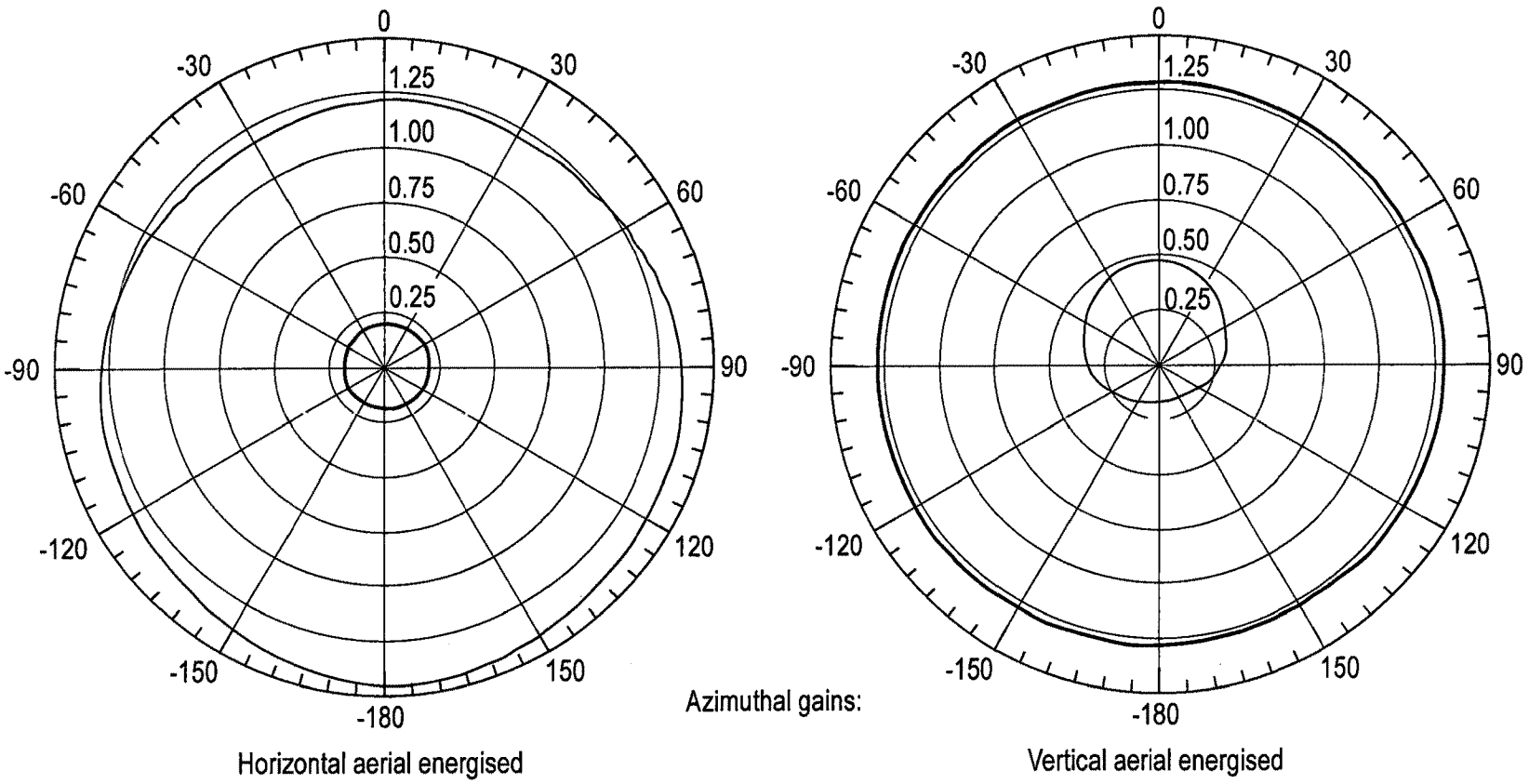
FIG. 7 is a set of polar diagrams showing the calculated performance with azimuthal angle for each of left, right, left hand circular and right hand circular polarisation.
Figure 7:
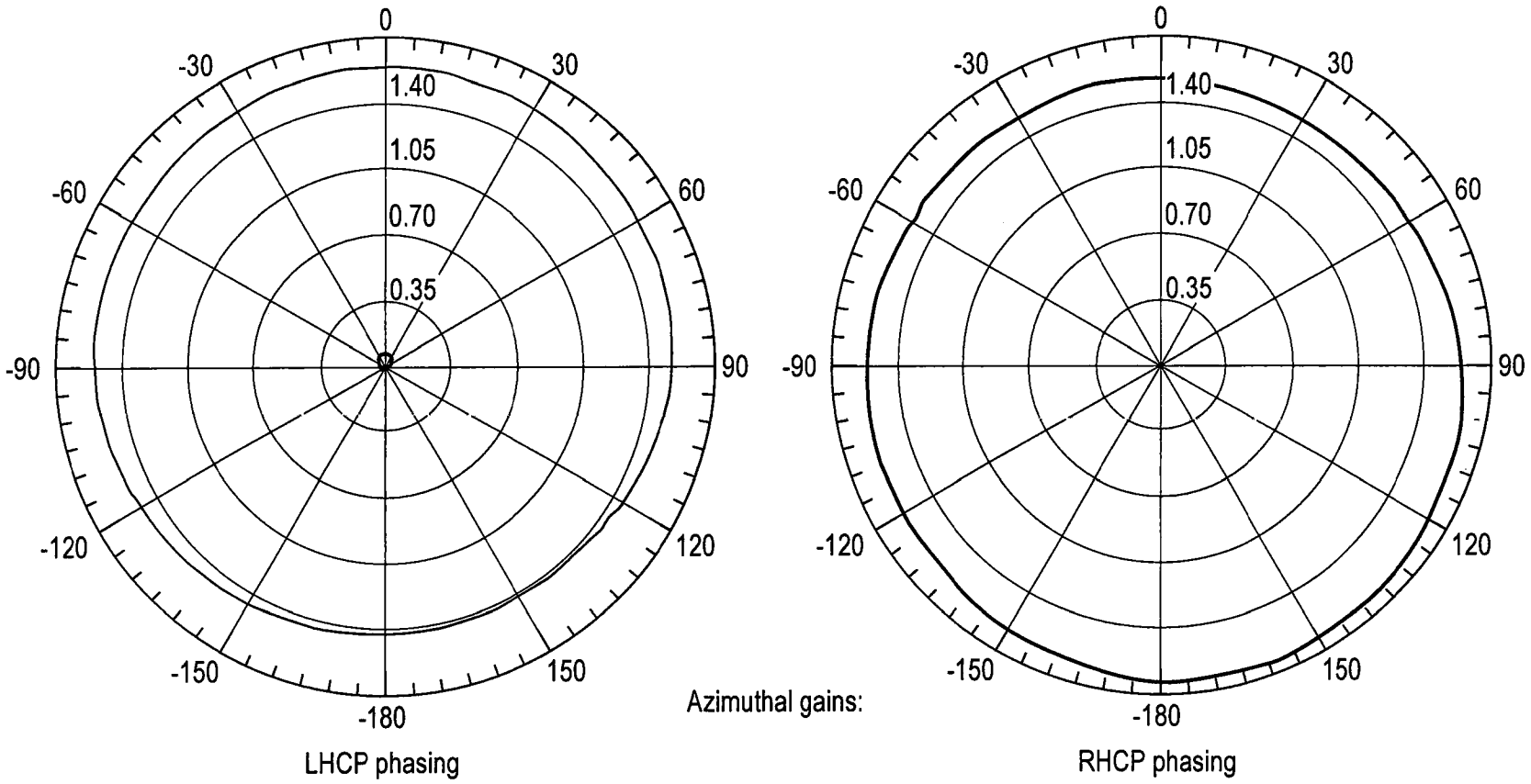

Calculated radiation patterns shown in FIG. 7 show the calculated in of the antenna when fed with each of the desired inputs. All of the patterns show very similar gain and exhibit very little azimuthal variation. When the either just the horizontal or vertical antenna is energised then the un-wanted cross-polar radiation is low. When the antennas are energised to form either left hand circular or right hand circular polarisations then the cross-polar radiation just adds to the gain and quite low cross-polar radiation is achieved.

The DVB-NGH (Next Generation Handheld) standard uses a number of advanced RF techniques to achieve improved service ruggedness and capacity. Signal fading in a multipath channel can cause significant loss of signal, one way to combat this is to introduce transmit diversity. When there is sufficient de-correlation between the transmission paths produced by the multiple transmitters then the fading is reduced and the system is more reliable.

DVB-NGH implements transmit diversity by producing linearly polarised 2×2 MIMO from terrestrial transmitters and circularly polarised 2×2 MIMO from satellite, producing a 4×4 MIMO scheme, which depending on the coding can either be used to enhanced throughput or for transmit diversity.

MIMO is generated by taking one of more data streams and multiplying by a MIMO coding matrix. This matrix can be modified to include a phase term to produce the required 90° required for generation of circular polarisation from linear antennas. Each stream can have an independent phase shift, so left and right hand circularly polarised radiation can simultaneously be obtained from one cross-polar pair of antennas.

When linearly polarised antennas are used to generate circular polarisation there is likely to be unwanted coupling between the polarisations and hence unwanted cross-polar radiation. That coupling can be removed by modifying further modification of the coding matrix to add the inverse antenna coupling at baseband thus cancelling the actual unwanted cross-polar radiation.

One way of modifying the coding matrix is now described.

MIMO rotational pre-coding for linear polarisation may be used to enhance cross-polar MIMO system performance and takes the form of a matrix M $$M = \begin{bmatrix} \cos\theta & -\sin\theta \\ \sin\theta & \cos\theta \end{bmatrix} \tag{1}$$

This is applied to the original complex baseband signal s (with elements $s_0$ and $s_1$ as follows:

$$\hat{s}=Ms \tag{2}$$

i.e.

$$\begin{bmatrix} \hat{s}_0 \\ \hat{s}_1 \end{bmatrix} = \begin{bmatrix} \cos\theta & -\sin\theta \\ \sin\theta & \cos\theta \end{bmatrix} \begin{bmatrix} s_0 \\ s_1 \end{bmatrix} \tag{3}$$

where and $\hat{s}_0$ and $\hat{s}_1$ are the resultant pre-coded signals.

Suppose the antenna is itself non-ideal, being characterised by a cross-coupling matrix P:

$$\begin{bmatrix} \hat{x}_V \\ \hat{x}_H \end{bmatrix} = \begin{bmatrix} P_{11} & P_{12} \\ P_{21} & P_{22} \end{bmatrix} \begin{bmatrix} x_V \\ x_H \end{bmatrix} \tag{4}$$

Here $$P = \begin{bmatrix} P_{11} & P_{12} \\ P_{21} & P_{22} \end{bmatrix}, \tag{5}$$

$x_V$ and $x_H$ are the intended vertical and horizontal terms respectively, and $\hat{x}_V$ and $\hat{x}_H$ are the actual signals following undesirable cross-coupling by the matrix P.

In this case, assuming P is invertible, we can modify the rotational pre-coding matrix to compensate as follows:

$$\hat{M} = \frac{1}{\det(P)} \begin{bmatrix} P_{22}\cos\theta - P_{12}\sin\theta & -P_{22}\sin\theta - P_{12}\cos\theta \\ -P_{21}\cos\theta + P_{11}\sin\theta & P_{21}\sin\theta + P_{11}\cos\theta \end{bmatrix} \tag{6}$$

where $$det(P)=P_{11}P_{22}-P_{12}P_{21} \tag{7}$$

The supplementary pre-coding to impart (in addition) circular polarisation to a linear (H/P) antenna array can be written $$\begin{bmatrix} \tilde{s}_0 \\ \tilde{s}_1 \end{bmatrix} = \begin{bmatrix} 1 & 1 \\ j & -j \end{bmatrix} \begin{bmatrix} \hat{s}_0 \\ \hat{s}_1 \end{bmatrix} \tag{8}$$

where $\hat{s}_0$ and $\hat{s}_1$ are the rotationally the pre-coded signals already described and $\tilde{s}_0$ and $\tilde{s}_1$ feature in addition the intended circular polarisation.

In this case, in the presence of cross-coupling matrix P, we can modify the totality of the pre-coding as follows:

$$\begin{bmatrix} \tilde{s}'_0 \\ \tilde{s}'_1 \end{bmatrix} = \frac{1}{\det(P)} \begin{bmatrix} P_{22} - jP_{21} & P_{22} + jP_{21} \\ -P_{12} + jP_{11} & -P_{12} - jP_{11} \end{bmatrix} \begin{bmatrix} \cos\theta & -\sin\theta \\ \sin\theta & \cos\theta \end{bmatrix} \begin{bmatrix} s_0 \\ s_1 \end{bmatrix} \tag{9}$$

Accordingly, cross coupling due to the close proximity of the two antennas in an embodiment can be negated by choice of the pre-coding coefficients as described.

Whilst described in relation to a camera system, for the avoidance of doubt, other systems are envisaged that may use one or more of the antenna arrangements described, including base stations, broadcast systems, television broadcast apparatus, mobile devices, mobile telephones and indeed any system or device using an antenna that may produce more than one polarisation.

The invention claimed is:

1. An RF antenna arrangement for transmitting two or more polarisations of radio signal, comprising:

a dipole array comprising first and second conductors comprising tracks laid on opposing surfaces of a printed circuit board and arranged in parallel planes separated by the printed circuit board and having connections for an RF feed, the first and second conductors cooperating for generating horizontally polarised RF signals;

the first conductor including a central portion and orthogonal tracks extending outwardly from the central portion and the second conductor including a central portion and orthogonal tracks extending outwardly from the central portion, the central portion and tracks of the second conductor on a surface aligned with the central portion and tracks of the first conductor on the opposing surface;

a monopole arrangement comprising a third conductor extending substantially orthogonal to the parallel planes and extending from a central portion of the first and second conductors and having connections for an RF feed for generating vertically polarised RF signals;

wherein the connections for the RF feeds for the first, second and third conductors are arranged so that the second conductor is connected as a common ground for the RF feed for the monopole arrangement whereby the second conductor acts as a ground plane for the third conductor, thereby providing a compact dual polarised omni-directional antenna.

2. An RF antenna arrangement according to claim 1, wherein the third conductor is connected at the central portion of the second conductor.

3. An RF antenna arrangement according to claim 2, wherein the aligned first and second conductors with central portions and orthogonal tracks are each generally cross shaped.

4. An RF antenna arrangement according to claim 1, wherein the third conductor extends on one side of the printed circuit board and the second conductor is on an opposite side of the printed circuit board.

5. An RF antenna arrangement according to claim 1, wherein the feeds for the first, second and third conductors comprise coaxial cables with inner and outer conductors, and wherein the connections are arranged so that the outer conductors connect to the second conductor.

6. An RF antenna arrangement according to claim 1, wherein the central portion of the second conductor is enlarged relative to the central portion of the first conductor.

7. An RF antenna arrangement according to claim 6, wherein the connections are at the enlarged central portion of the second conductor.

8. An RF antenna arrangement according to claim 1, wherein the aligned first and second conductors with central portions and orthogonal tracks are generally cross shaped.

9. A broadcast system comprising one or more antenna arrangements according to claim 1.

10. A television camera comprising one or more antenna arrangements according to claim 1.

11. A broadcast system having an RF antenna arrangement for transmitting two or more polarisations of radio signal, comprising:

a dipole array comprising first and second conductors comprising tracks laid on opposing surfaces of a printed circuit board and arranged in parallel planes separated by the printed circuit board and having connections for an RF feed, the first and second conductors cooperating for generating horizontally polarised RF signals;

the first conductor including a central portion and orthogonal tracks extending outwardly from the central portion and the second conductor including a central portion and orthogonal tracks extending outwardly from the central portion, the central portion and tracks of the second conductor on a surface aligned with the central portion and tracks of the first conductor on the opposing surface;

a monopole arrangement comprising a third conductor extending substantially orthogonal to the parallel planes and extending from a central portion of the first and second conductors and having connections for an RF feed for generating vertically polarised RF signals;

wherein the connections for the RF feeds for the first, second and third conductors are arranged so that the second conductor is connected as a common ground for the RF feed for the monopole arrangement whereby the second conductor acts as a ground plane for the third conductor thereby providing a compact dual polarised omni-directional antenna.

12. A broadcast system having two antenna arrangements according to claim 11, one of the antenna arrangements configured for horizontal and vertical polarisation, the other antenna arrangement configured for left and right circular polarisation.

13. A broadcast system according to claim 12, wherein the two antenna arrangements are configured to broadcast a MIMO signal.

14. A broadcast system according to claim 12, wherein the system is configured for one of the DVB standards.

15. A television camera having two antenna arrangements according to claim 11, one of the antenna arrangements configured for horizontal and vertical polarisation, the other antenna arrangement configured for left and right circular polarisation.

16. A television camera according to claim 15, wherein the two antenna arrangements are mounted in close proximity, one displaced vertically from the other.

17. A television camera according to claim 15, wherein the two antenna arrangements are configured to broadcast a MIMO signal.

18. A broadcast system according to claim 13 or a television camera according to claim 17, having circuitry arranged to pre-code MIMO signals.

19. A broadcast system according to claim 13 or a television camera according to claim 17, having circuitry arranged to pre-code MIMO signals according to $$\begin{bmatrix} \tilde{s}_0' \\ \tilde{s}_1' \end{bmatrix} = \frac{1}{\det(P)} \begin{bmatrix} P_{22} - jP_{21} & P_{22} + jP_{21} \\ -P_{12} + jP_{11} & -P_{12} - jP_{11} \end{bmatrix} \begin{bmatrix} \cos\theta & -\sin\theta \\ \sin\theta & \cos\theta \end{bmatrix} \begin{bmatrix} s_0 \\ s_1 \end{bmatrix}$$

connected to the first, second and third conductors wherein P is a cross-coupling matrix with elements $s_0$ and $s_1$ and $\tilde{s}_0$ and $\tilde{s}_1$ are intended circular polarisation.

* * * * *